US010245467B2

(12) United States Patent
Britt et al.

(10) Patent No.: US 10,245,467 B2
(45) Date of Patent: Apr. 2, 2019

(54) PISTON CONFIGURATIONS FOR PNEUMATIC POGO STICK

(71) Applicant: Vurtego, LLC, Mission Viejo, CA (US)

(72) Inventors: Ian Britt, West Covina, CA (US); Brian James Spencer, Corona Del Mar, CA (US)

(73) Assignee: Vurtego, LLC, Mission Viejo, CA (US)

( * ) Notice: Subject to any disclaimer, the term of this patent is extended or adjusted under 35 U.S.C. 154(b) by 0 days.

(21) Appl. No.: 14/789,809

(22) Filed: Jul. 1, 2015

(65) Prior Publication Data

US 2016/0001134 A1 Jan. 7, 2016

Related U.S. Application Data

(60) Provisional application No. 62/019,538, filed on Jul. 1, 2014.

(51) Int. Cl.

| | |
|---|---|
| ***A63B 25/00*** | (2006.01) |
| ***F16F 9/00*** | (2006.01) |
| ***A63B 25/08*** | (2006.01) |
| *A63B 21/008* | (2006.01) |

(52) U.S. Cl.

CPC ..... *A63B 25/08* (2013.01); *A63B 21/0083* (2013.01); *A63B 21/0087* (2013.01)

(58) Field of Classification Search

CPC ... A63B 25/08; A63B 21/0083; A63B 21/008; A63B 21/0085; A63B 21/0087; A63B 21/0088; A63B 5/00; A63B 5/16; A63B 2244/08

See application file for complete search history.

(56) References Cited

U.S. PATENT DOCUMENTS

| | | | | |
|---|---|---|---|---|
| 2,865,633 | A * | 12/1958 | Woodall | A63B 25/08 446/176 |
| 3,351,342 | A | 11/1967 | Guin | |
| 3,495,671 | A | 2/1970 | Samiran | |
| 3,627,314 | A | 12/1971 | Brown | |
| 3,731,920 | A | 5/1973 | Matsuda | |
| 3,765,673 | A | 10/1973 | Daw | |
| 3,773,320 | A | 11/1973 | Samiran et al. | |
| 3,782,352 | A | 1/1974 | Sparber | |
| 3,853,195 | A | 12/1974 | Rasanen | |

(Continued)

FOREIGN PATENT DOCUMENTS

| | | |
|---|---|---|
| GB | 2 226 769 A | 11/1990 |
| WO | WO 99/61111 | 12/1999 |

*Primary Examiner* — Stephen R Crow

(74) *Attorney, Agent, or Firm* — Knobbe Martens Olson & Bear LLP

(57) ABSTRACT

A pneumatic pogo stick is provided that utilizes compressed air like a spring to have a potentially higher power to weight ratio than a comparable coil spring pogo stick. The pneumatic pogo stick includes an elongate cylindrical housing which forms a cylinder. Improvements are also provided to the piston and air shaft that allow for reduced hammering and a lower maximum compression ratio in order to provide relatively smooth jumping and landing while propelling a user to greater heights. Examples of such improvements include a hollow air shaft and modifications to the shape and structure of the piston.

13 Claims, 14 Drawing Sheets

(56) References Cited

U.S. PATENT DOCUMENTS

| | | | | |
|---|---|---|---|---|
| 3,855,979 | A | 12/1974 | Ottaway | |
| D236,485 | S | 8/1975 | Mox | |
| 3,977,094 | A | 8/1976 | Rivera et al. | |
| 4,243,218 | A | 1/1981 | DeSousa | |
| 4,632,371 | A | 12/1986 | Wirges et al. | |
| 4,902,004 | A | 2/1990 | Gerlach | |
| 5,087,037 | A * | 2/1992 | Morrow | A63B 25/08 472/134 |
| 5,292,295 | A | 3/1994 | Gerlach | |
| 6,126,578 | A | 10/2000 | Lapointe | |
| 6,168,555 | B1 | 1/2001 | Fetterleigh et al. | |
| 6,503,177 | B2 | 1/2003 | Herman | |
| 6,558,265 | B1 | 5/2003 | Middleton | |
| 6,619,634 | B2 | 9/2003 | Chen et al. | |
| 6,694,861 | B2 | 2/2004 | Glasson | |
| 6,726,603 | B1 | 4/2004 | Beaute et al. | |
| 6,827,673 | B2 | 12/2004 | Chen et al. | |
| 6,964,634 | B2 | 11/2005 | Wojtkiewicz et al. | |
| 7,011,608 | B2 | 3/2006 | Spencer | |
| 2002/0158379 | A1 * | 10/2002 | Chen | C21B 7/10 266/280 |
| 2002/0160888 | A1 * | 10/2002 | Chen | A63B 21/157 482/57 |
| 2003/0092537 | A1 * | 5/2003 | Spencer | A63B 25/08 482/77 |
| 2007/0232467 | A1 * | 10/2007 | Puzey | A63B 21/4015 482/112 |

* cited by examiner

FIG. 7A
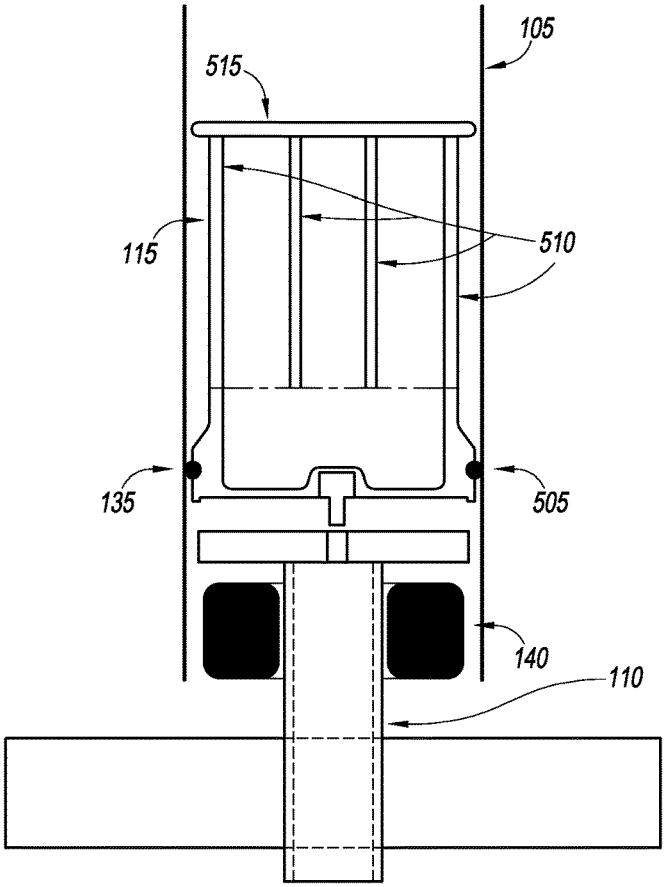
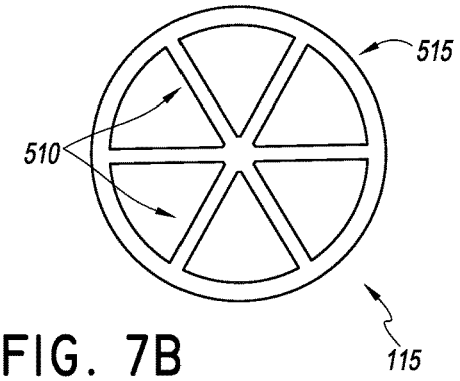
FIG. 7B

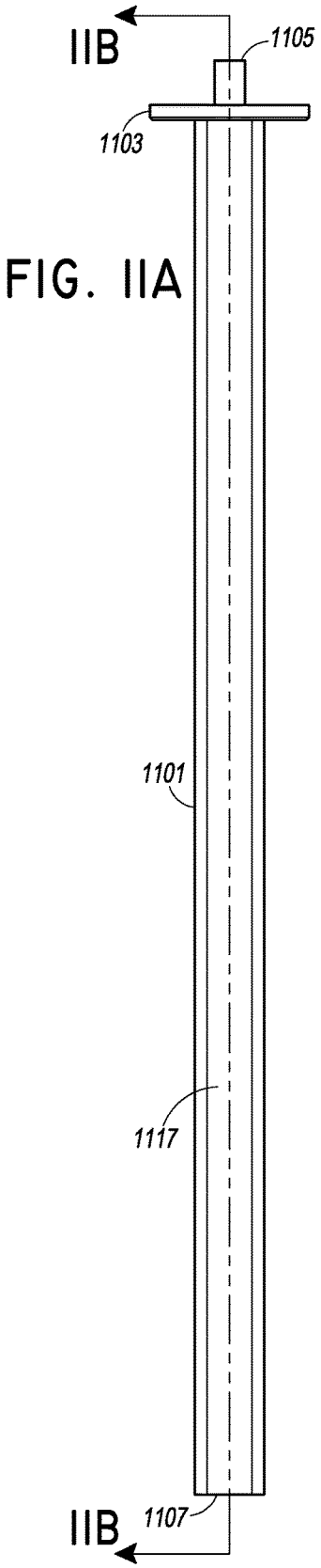
FIG. IIA
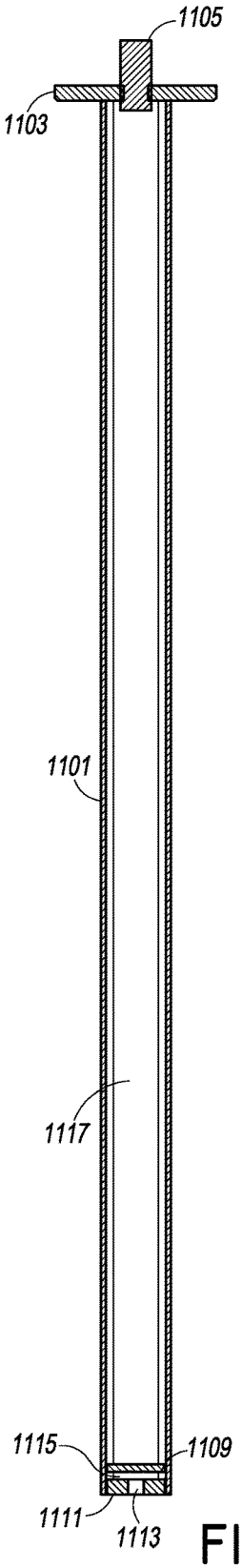
FIG. IIB

PISTON CONFIGURATIONS FOR PNEUMATIC POGO STICK

PRIORITY AND INCORPORATION BY REFERENCE

This application claims the priority and benefit of U.S. Provisional Application No. 62/019,538, filed Jul. 1, 2014, which is hereby incorporated by reference herein in its entirety for all purposes.

BACKGROUND

Field of the Invention

The present invention generally relates to pogo sticks, and more specifically to pneumatic pogo sticks.

Description of the Related Art

A conventional pogo stick utilizes a coil spring within a hollow tube housing to create an upward force when compressed by a user to propel the user in an upward direction. In order to get more lift than can be provided with a coil spring and without increasing the weight of the pogo stick itself, it has been recognized in the art that an air filled cylinder/piston arrangement can produce increased propulsion or lift for the same length of stroke. Some have gone so far as incorporating engine power in order to increase lift and provide a powered jumping stick.

Various attempts have been made in the art to provide pneumatic pogo sticks. One example of an air-type pogo stick includes a cylinder to which foot - boards are attached in a body. The cylinder has a valve through which a user can regulate the space within the cylinder. The pogo stick is simultaneously worked by both pressure power and vacuum power created in the upper and lower part of the piston in the cylinder respectively when exerted by an outside force. Such a pogo stick, however, has many shortcomings in both construction and functionality and fails to address many of the problems encountered when attempting to use compressed air as a spring.

Pogo stick users have creatively learned to do pogo stick tricks while they are propelled upward. Extreme tricks are common now in many official sports, such as snowboarding, skateboarding, and extreme motorsports, and many users have implemented extreme tricks on pogo sticks. Thus, it would be advantageous to provide a pneumatic pogo stick that allows for relatively smooth jumping and landing while allowing the user to obtain greater height to have more hang-time for more creative and complicated tricks.

SUMMARY

The systems, methods and devices described herein have innovative aspects, no single one of which is indispensable or solely responsible for their desirable attributes. Without limiting the scope of the claims, some of the advantageous features will now be summarized.

In some embodiments, the pogo stick may comprise a housing, a sliding shaft, and a piston. The piston may be connected to the sliding shaft and the sliding shaft may be disposed in the housing. The sliding shaft may define a hollow chamber that fluidly communicates with a space between the piston and the housing.

In some embodiments, the pogo stick may comprise a housing, a sliding shaft, and a piston. The piston may be connected to the sliding shaft and the sliding shaft may be disposed in the housing. The piston may define a concave shape. An upper surface of the piston may be concave. Portions of the piston may define a void, such that a space between the piston and the housing may include the void. The piston may be cup-shaped.

In some embodiments, the pogo stick may comprise a housing, a sliding shaft, and a piston. The piston may be connected to the sliding shaft and the sliding shaft may be disposed in the housing. The piston may define a concave shape. The sliding shaft may define a hollow chamber that fluidly communicates with a space between the piston and the housing.

In some embodiments, the pogo stick may comprise a housing, a sliding shaft, and a piston. The piston may be connected to the sliding shaft and the sliding shaft may be disposable in the housing. The piston may comprise one or more structural supports that extend in a generally upward direction and may contact a wall of the housing.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements. Not all of the elements of the drawings are in to scale relate to other drawings and the comparative size of one element relative to another element in the drawings is not necessarily indicative of the relative sizes of the elements in one or more embodiments.

FIG. 7A shows a side elevational cross-section view of at least a piston comprising a support structure.

FIG. 7B shows a top plan view of a piston comprising a support structure.

FIG. 11A shows a side elevational cross-section view of one embodiment of an air shaft.

FIG. 11B shows a side elevational cross-section view of one embodiment of an air shaft.

DETAILED DESCRIPTION

Figure 1:
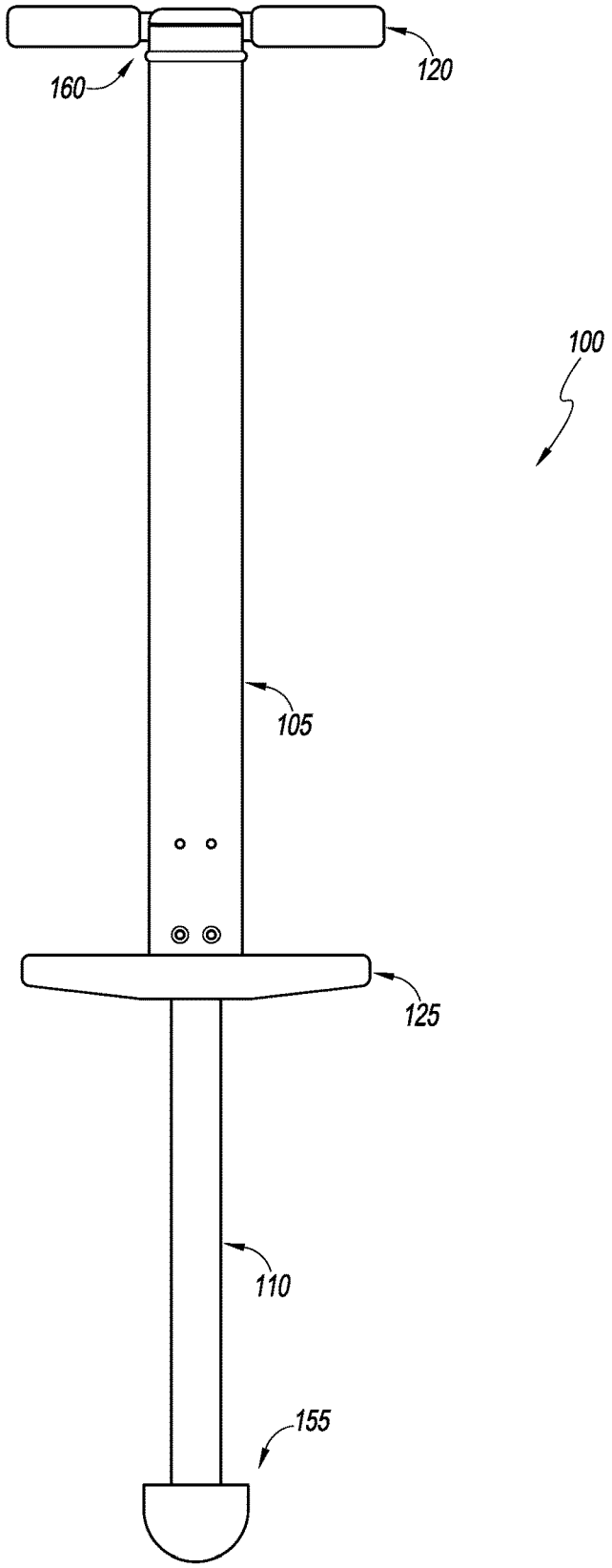
FIG. 1 shows a side elevational view of an embodiment of a pneumatic pogo stick.

One patent, U.S. Pat. No. 7,011,608, is incorporated by reference in its entirety for all purposes. It discloses an invention that utilizes a pneumatic spring, which includes a piston/cylinder with user graspable handles attached or coupled relative to the top of the cylinder, and an elongated shaft attached to the bottom of the piston. Thus, stepping or jumping on the foot supports pushes the piston upward, compressing the air inside the cylinder. This compressed air acts like a spring creating a force on the piston, thus forcing the piston and the attached shaft away from the handles, which in turn propels the cylinder, the foot supports attached thereto, and, ultimately, the user. Such a pneumatic pogo stick has a potentially higher power to weight ratio than a comparable coil spring pogo stick, and has a maximum compression ratio that helps provide smooth jumping and landing.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Elements that are described as "connected," "engaged," "attached," or similarly described, shall include being directly and/or indirectly connected, engaged, attached, etc. Alterations and further modifications of the inventive features illustrated herein, and additional applications of the principles of the inventions as illustrated herein, which would occur to one skilled in the art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description" one will understand how illustrated features serve to explain certain principles of the present disclosure.

Figure 2:
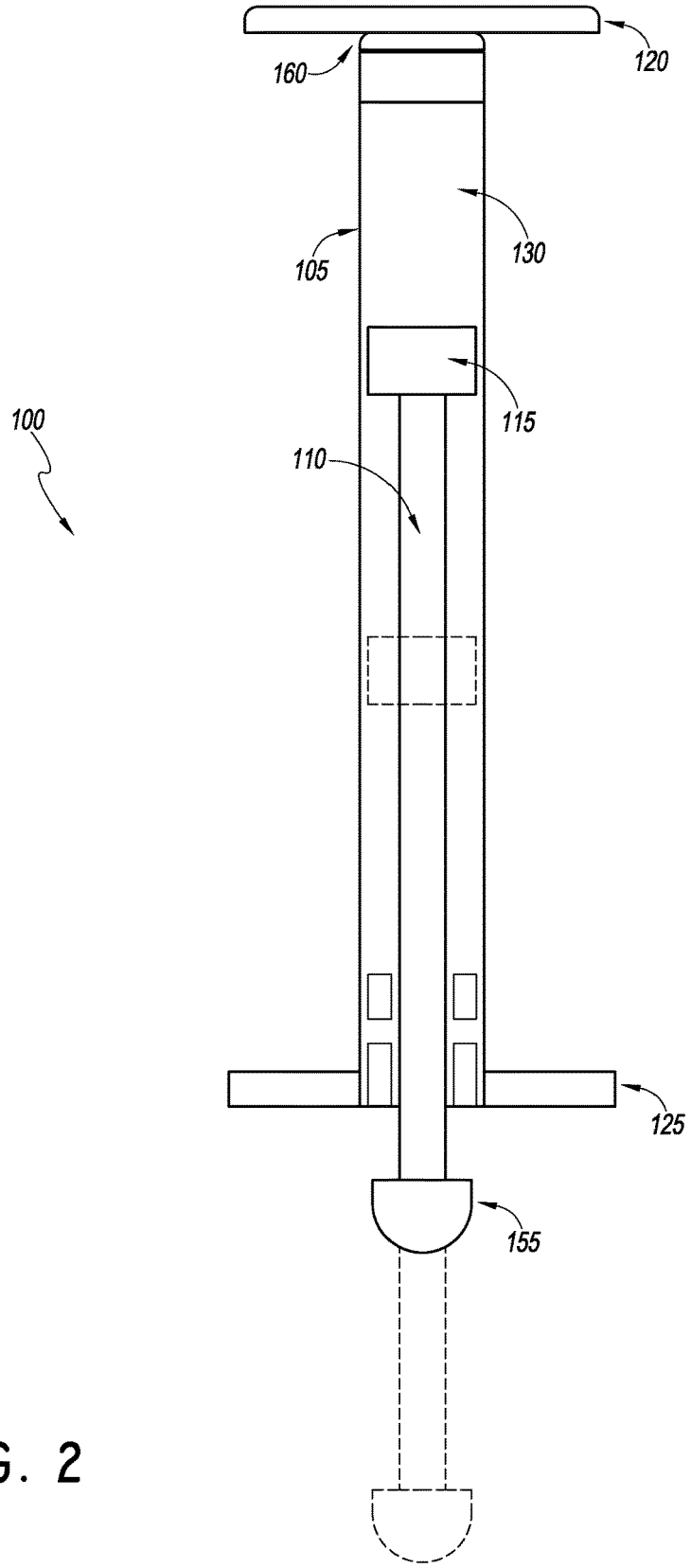
FIG. 2 shows a side elevational cross-section view of a pogo stick.

As shown in FIGS. 1 and 2, a pneumatic pogo stick 100 may comprise a main tube or housing 105, a sliding shaft 110, a piston 115, a handle 120, and foot rests 125. The sliding shaft 110 may generally be configured to move in and out of the housing 105 in a longitudinal direction. In some embodiments, the longitudinal direction of the movement of the sliding shaft 110 may be substantially parallel to the longitudinal axis of the housing 105. A handle 120 may be connected to the top of the housing 105. The handle 120 may serve the purpose of allowing a user to grip the pogo stick 100. Foot rests 125 may provide a location on which a user can stand. In some embodiments, the housing 105 comprises a generally cylindrical shape, although the housing 105 may comprise other shapes such as frustoconical, square, hexagonal, octagonal, or other similar shape. The sliding shaft 110 may comprise a generally cylindrical shape, or some other shape, such as square, hexagonal, octagonal, or some other shape. The handle 120 and/or foot rests 125 may be temporarily or permanently attached to the housing 105.

In some embodiments, the pneumatic pogo stick 100 is used by a user gripping the handle 120 and stepping onto the foot rests 125, and then moving in an up-and-down motion. As the user and the pogo stick 100 impact the ground, the sliding shaft 110 may have a tendency to slide up and into the housing 105. In some embodiments, the space within the housing above the piston 130 is reduced. If air or another gas is trapped in that confined space 130, the pressure of that gas may increase. The increase in pressure may store potential energy, which may exert a force on the top of the piston 115 pushing down, as well as on the top of the housing 105 pushing up. When the sliding shaft 110 is inserted into the housing 105, the user may push down on the foot rests 125 simultaneously to the gas pushing up on the top a housing 105, which may help propel the user and pogo stick 100 in a generally upward direction. This process may be repeated more than once, and may be repeated indefinitely.

The housing 105 may comprise PVC, polycarbonate, metal, plastic, or other material, and may be created through casting, extruding, welding, or other various manufacturing techniques. The wall thickness of the housing 105 may be between a few millimeters and one or more centimeters thick. In some embodiments, it may be advantageous for the housing 105 to be lightweight, and this may be accomplished using generally lightweight materials and/or a thinner wall thickness.

Figure 3:
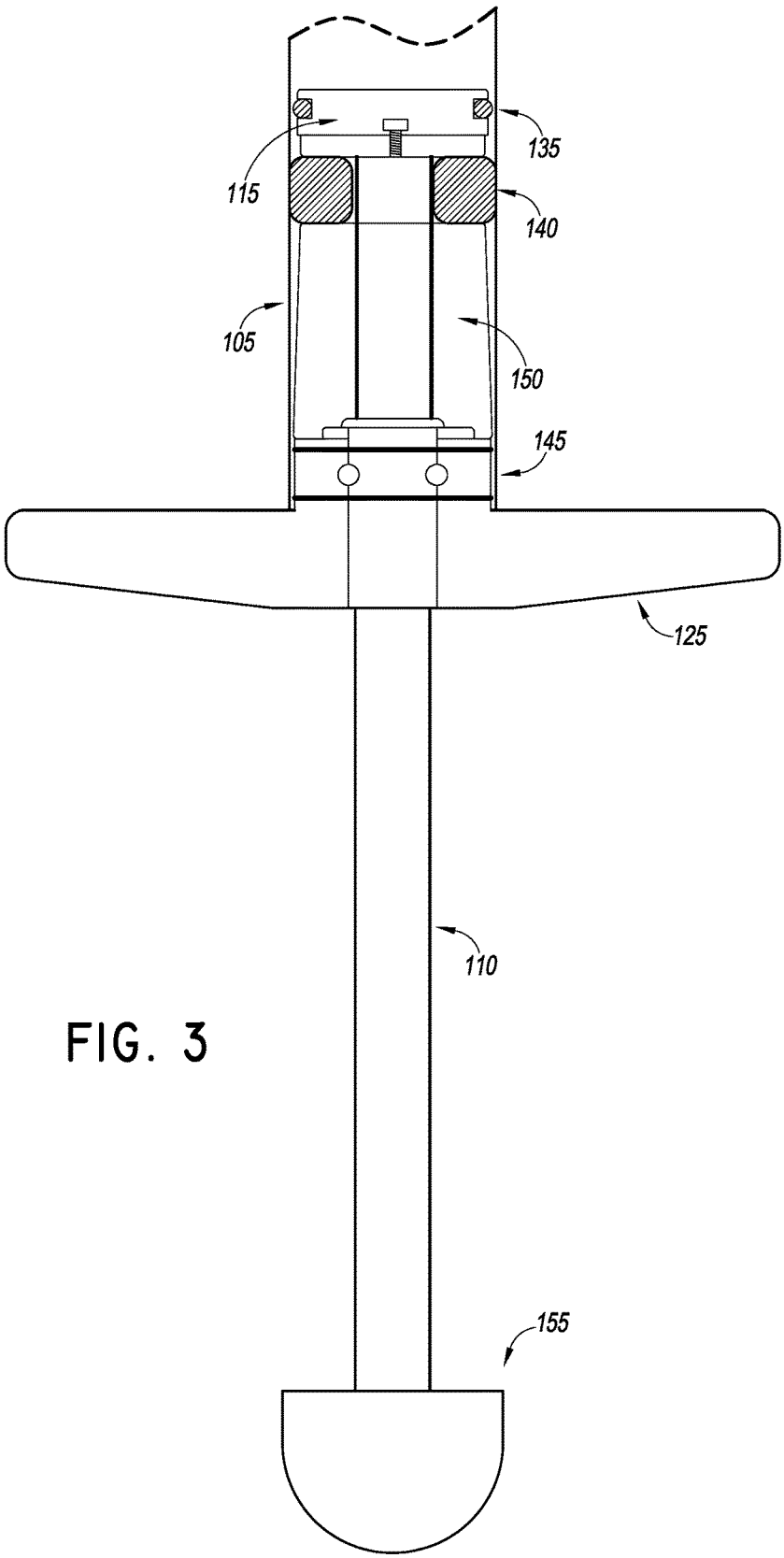
FIG. 3 shows a side elevational cross-section view of part of a pogo stick.

With reference to FIG. 3, the piston 115 may comprise a device which substantially interacts with the inside wall of the housing. In some embodiments, a gasket or seal 135 may be present which may help prevent gases from moving around the piston 115, for example from the confined space 130 to below the piston 115. The piston 115 may form various shapes depending on the application. A bumper 140 may be disposed below the piston 115 and above a bushing 145, such that when the sliding shaft 110 extends out from the housing 105, the bottom of the piston 115 may impact or contact the bumper 140. The bumper 140 may serve the function of limiting the travel of the sliding shaft 110 and/or piston 115, and may help prevent damage to any of the parts. The bumper 140 may comprise rubber, plastic, nylon, or other various materials that may serve the function of limiting the motion of the sliding shaft 110 and/or piston 115, and prevent any of the moving parts from damage. Further, a spacer 150 may be disposed between the bumper 140 and the bushing 145. The spacer 150 may comprise plastic, nylon, or other various materials.

In some embodiments, a bushing 145 may be disposed at the bottom of the housing 105 near the foot rests 125, and below the bumper 140 and/or spacer 150. When the sliding shaft 110 is fully extended, the bumper 140 may be disposed between the bottom of the piston 115 and the top of the bushing 145. The bushing 145 may comprise an aperture through which the sliding shaft may travel. The bushing 145 may help keep the sliding shaft 110 aligned, such that the sliding shaft 110 does not rotate coaxially to the housing 105. For instance, the cross-section of the sliding shaft 110 may be generally square, and the aperture in the bushing 145 may also be square. This configuration may prevent the sliding shaft 110 from substantially spinning around or turning. The bushing 145 may also help prevent the sliding shaft 110 from rotating about an axis perpendicular to an axis of the housing 105. The bushing 145 may comprise a metal or other generally rigid material, and may define an aperture through which the sliding shaft 110 may travel. The bushing 145 may be temporarily or permanently attached to the housing, and in some instances may be pressed fit to the housing 105. For instance, as a non-limiting example, when the user and the pogo stick 100 are impacting a surface, the sliding shaft 110 may be in a fully extended position and have maximum exposure outside of the housing 105. If the user and the pogo stick 100 do not land in an exactly vertical direction, the force of the ground on the sliding shaft 110 may not be parallel to the direction of travel of the user and the housing 105. In such an instance, the housing 105 may have a tendency to rotate about an axis generally horizontal and may place a bending force on at least part of the sliding shaft 110. It may be advantageous to reinforce the sliding shaft 110 with a bushing 145 in order to resist this bending force.

In some embodiments, the sliding shaft 110 may comprise a bounce pad 155 at the bottom of the shaft 110, and may generally contact the surface or ground upon which the pogo stick 100 is used. The bounce pad 155 may comprise a plastic, rubber, or other material. The bounce pad 155 may serve the purpose of gripping the ground surface, such that upon impact, the bounce pad 155 and/or sliding shaft 110 do not slip out from under the user. Additionally, the bounce pad 155 may help insulate the user from vibration or other forces. The bounce pad 155 may be attached to the sliding shaft 110 using glue, screws, bolts, or other various attachment methods.

In some embodiments, the top of the housing 105 may be sealed by a cap 160 that may be temporarily or permanently attached to the housing 105. The cap 160 may be attached using bolts, adhesives, chemicals, welding, or other attachment methods. The cap 160 may comprise a valve (not shown) through which gases may be inserted into the housing 105. The handles 120 may also be attached to the housing 105 and/or the cap 160, such that use of the handles 120 by the user to hold onto the pogo stick device 100, may not generally dislodge the handles 120 from the device.

In some embodiments, the sliding shaft 110 generally travels into and out of the housing 105, beginning at a maximum extension, and ending at a maximum compression. The maximum extension may be defined as the configuration when the sliding shaft 110 is slid out of the housing 105 as far as, or nearly as far as, the sliding shaft 110 can travel. Maximum compression may be defined as the configuration when the sliding shaft 110 is disposed into the housing as far as, or nearly as far as, possible. In these configurations, the volume of space 130 may comprise the volume above the piston 115, and below the cap 160, that is confined within the housing 105. In some embodiments, the volume of space 130 may comprise a gas, air, or specific gases such as nitrogen. Different gases at different pressures may be advantageous. For instance, as a non-limiting and illustrative example, the volume of space 130 may be filled with gas at a pressure higher than atmospheric pressure. The compression ratio may be defined as the volume of space 130 when the sliding shaft 110 is at an extension position divided by the volume of space 130 when the sliding shaft 110 is at a compression position. For instance, if the volume of space 130, when the sliding shaft 110 is an extension position is 20 in.$^3$, and the volume of space 130, when the sliding shaft 110 is at a compression position is 5 in.$^3$, then the compression ratio is 20÷5, or 4. This compression ratio may be, therefore, a function of at least the stroke length of the sliding shaft 110, the volume of space above the piston 130 at the extension position, and the volume of space above the piston 130 at the compression position. The compression ratio may also be a factor of the diameter of the housing 105 and the length of the housing 105.

A "hammering" effect may be caused when the pressure inside a compression chamber increases rapidly due to too high of a compression ratio. This effect is common in water pipes when a fluid in motion is forced to stop or change direction suddenly causing a large momentum change. When "hammering" happens on a pogo stick, the sudden change in pressure inside the chamber may also cause problems for the pogo stick user. This effect, however, can be reduced by modifying the compression ratio. This can be done in many ways including changing the stroke length such that at maximum compression the sliding shaft 110 is not disposed as far into the housing 105. This may increase the volume of space above the piston 130 at maximum compression, which may lower the compression ratio.

As used in this disclosure, the term "piston" should generally be given its plain and ordinary meaning of an object that fits snugly into a larger cylinder or tube and moves under fluid pressure. Variations to the shapes of the piston and/or the cylinder may be accomplished without deviating from the scope of the invention. For instance, as a non-limiting example, the piston shape may be elliptical in order to match the elliptical cross-sectional shape of the cylinder. The term "compression ratio" should generally be given its plain and ordinary meaning of the ratio of the volume between the piston and cylinder head before and after a compression stroke. In the case of a pogo stick, the compression stroke may comprise the sliding shaft moving from an extended position to a compressed position. The "maximum compression ratio" may be defined as the ratio of the volume between the piston and cylinder head before and after a compression stroke, when the piston travels from the maximum extension position to the maximum compression position. In embodiments with a maximum compression ratio, other compression ratios for the same embodiments may be possible, depending at least on the stroke length of the sliding shaft.

Hollow Sliding Shaft

Figure 4:
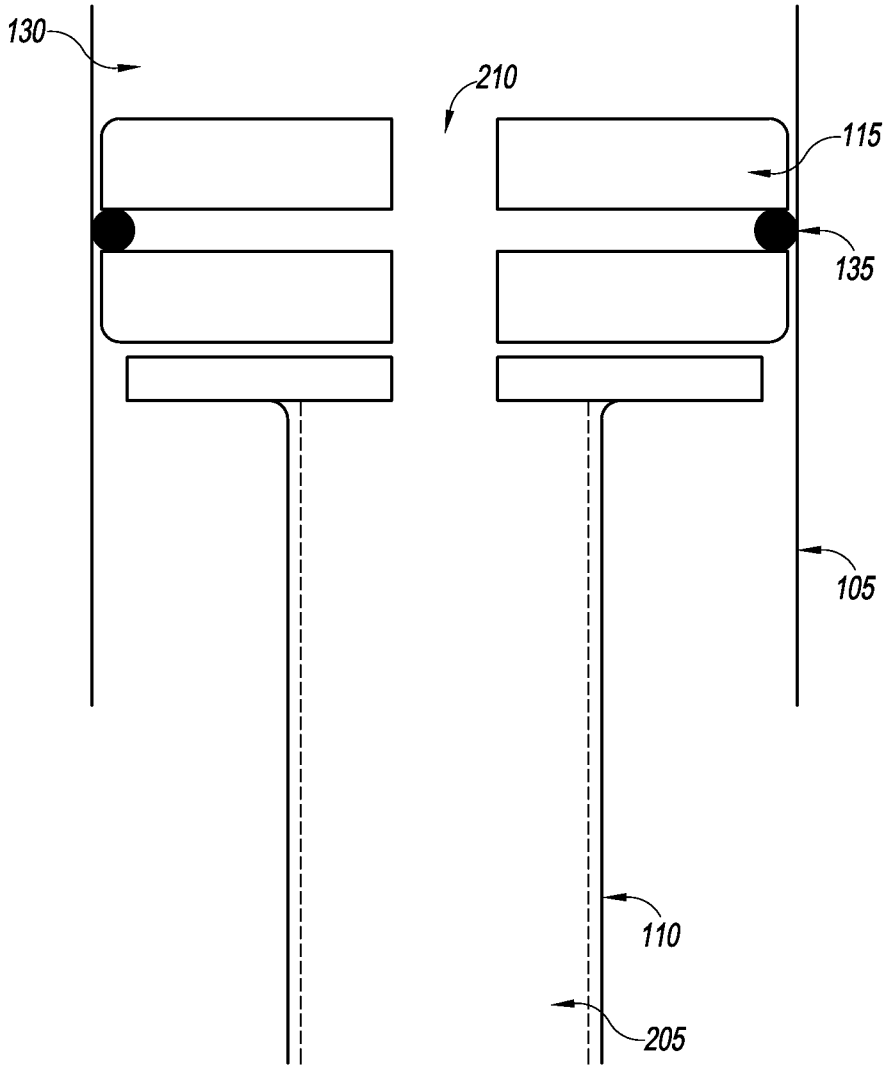
FIG. 4 shows a side elevational cross-section view of at least a piston.
Figure 5A:
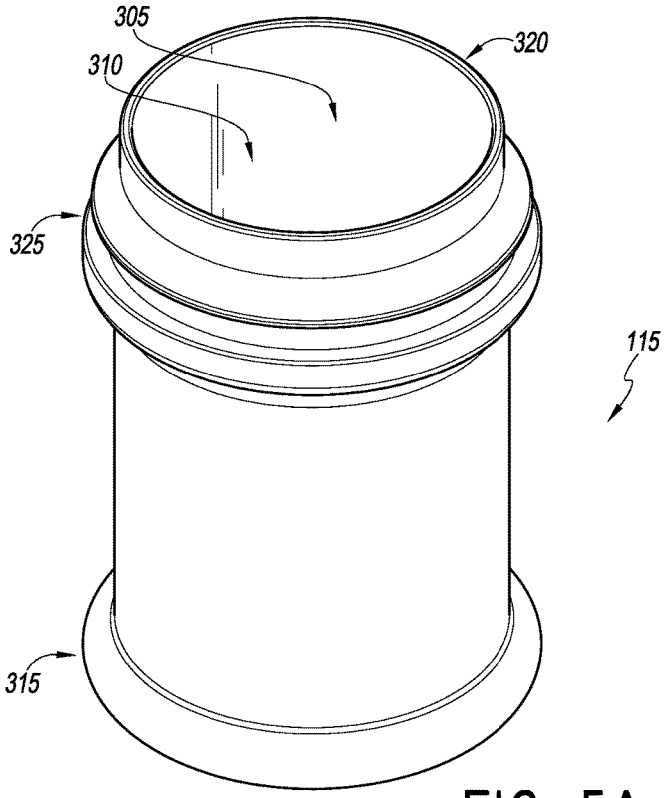
FIG. 5A shows a top, front, and side perspective view of a first embodiment of a hollow piston.
Figure 5B:
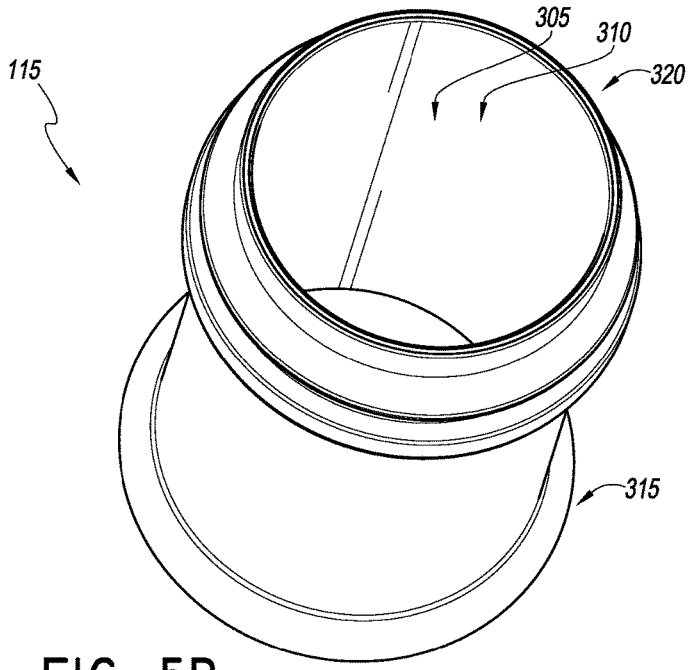
FIG. 5B shows a top, front, and side perspective view of a first embodiment of a hollow piston.
Figure 5C:
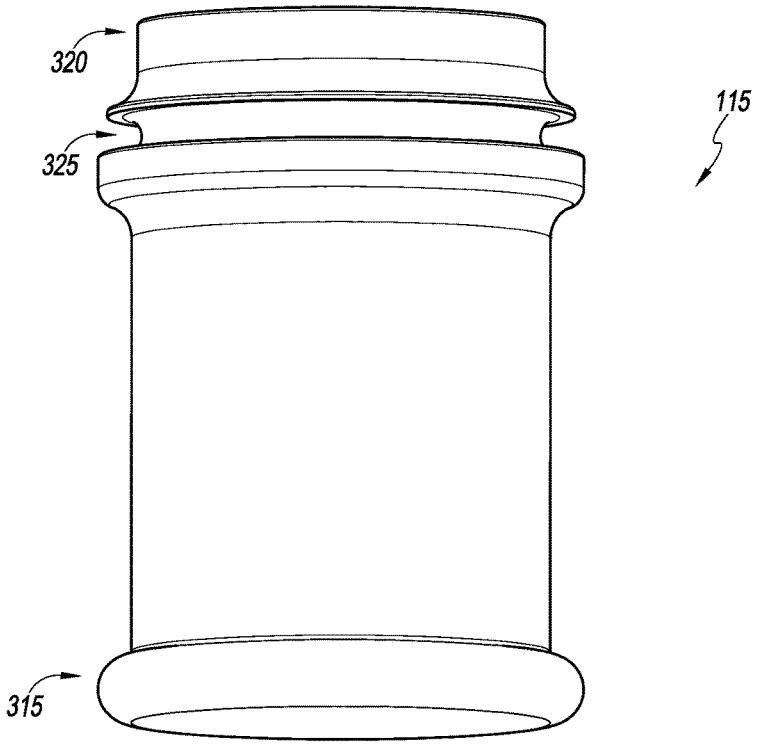
FIG. 5C shows a side elevational view of a first embodiment of a hollow piston.
Figure 5D:
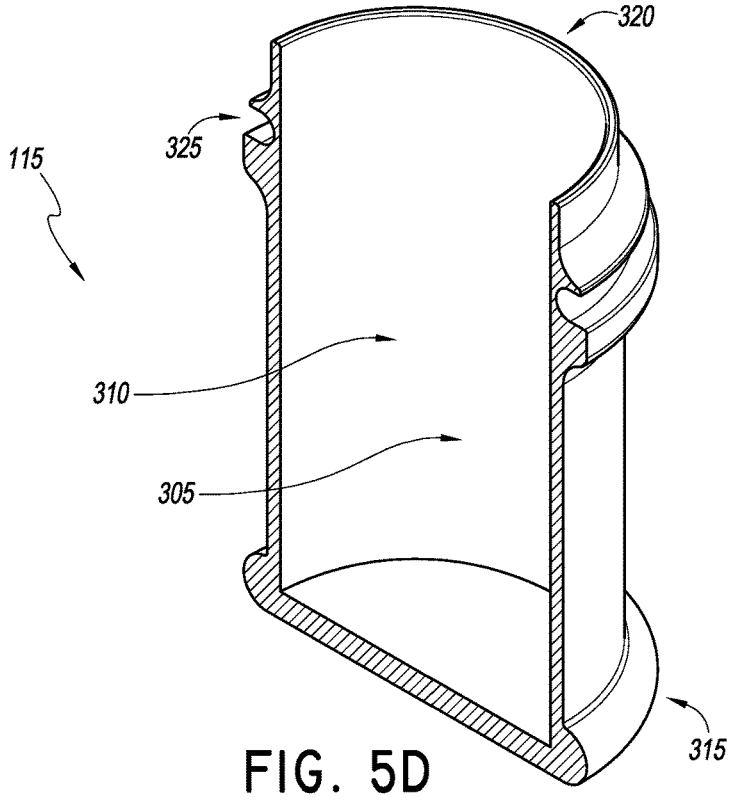
FIG. 5D shows a top, front, and side perspective cutaway view of a first embodiment of a hollow piston.

In some embodiments, the sliding shaft 110 may be configured to comprise a hollow chamber 205 inside and an opening 210 from the hollow chamber 205 through the piston 115, such that the volume of space 130 above the piston 115 fluidly communicates with the hollow chamber 205 inside the sliding shaft 110. This configuration may increase the volume of space 130 at maximum compression, which may decrease the compression ratio. The volume of space 130 may include both the space above the piston 115, between the piston 115 and the cap 160, as well as the volume of space within the sliding shaft 110 that fluidly communicates with the space above the piston 115. As shown in FIG. 4, the piston 115 may be attached to the top of the sliding shaft 110, and air may move from above the piston 115, through the piston 115, and into the hollow chamber 205 inside the sliding shaft 110. When the user compresses the volume of space 130 by jumping on the foot supports 125, the piston 115 compresses the air inside the cylinder above the piston 115 and within the hollow chamber 205 in the sliding shaft 110.

To illustrate by example, a pogo stick 100 without the hollow space 205 in the sliding shaft 110 may have a piston 115 with a stroke length of 18 inches, and 2 inches of length above the piston 115 at compression. The inside diameter of the housing 105 may be 3 inches (and a radius of 1.5 inches). The volume of a cylinder is (height)×(Π)×(radius squared). At extension, the volume of space 130 would be (18+2)(3.14)($1.5^2$) or 141.3 $in^2$. At compression, the volume of space 130 would be (2)(3.14)($1.5^2$) or 14.1 $in^2$. Therefore, the compression ratio would be 10:1. However, the volume of the hollow chamber 205 inside square sliding shaft 110 may be 1 inch by 1 inch by 25 inches long, or an additional 25 $in.^3$ of space, which may be added to the volume of space at extension and compression. Therefore, the compression ratio would be (141.3+25):(14.1+25) or 4.25. Other compression ratios may be possible depending at least on the stroke length, volume of space 130 above the piston 115 at compression, diameter of the cylinder 105, and volume of the hollow chamber 205 inside the sliding shaft 105.

In some embodiments, a spacer 150 is added between the bottom of the piston 115 and the bushing 145 (see FIG. 3). This spacer 150 may help prevent the piston 115 from coming too close to the bushing 145. If the piston 115 gets too close to the bushing 145, for instance when the sliding shaft 110 is at extension, then the sliding shaft 110 may have a tendency to bend at the bushing 145 or damage the piston 115 due to excessive force. The spacer 150 may create a longer moment arm of the sliding shaft 110 above the bushing 145, which may reduce the force on the side of the piston 115.

In addition to possible damage to the piston 115 or sliding shaft 110, a piston 115 being too close to the bushing 145 may increase friction between the piston 115 and the housing 105 and slow down the compression stroke. For instance, as a non-limiting example, if the piston 115 is too close to the bushing 145 when the sliding shaft 110 begins travel from an extension position, excessive force may be applied to the piston 115 by the cylinder wall. This increase in force may increase the friction between the piston 115 and cylinder wall, which may produce drag as the piston 115 moves through the housing 105 from the extension position to the compression position. The drag may decrease the speed at which the piston 115 travels, and may prevent the piston 115 from reaching the maximum compression position. In order to alleviate this drag, a spacer 150 may be placed between the bumper 140 and the bushing 145, which may prevent the piston 115 from getting too close to the bushing 145, and thus reducing the amount of drag experienced by the piston 115 during the compression stroke.

With reference to FIGS. 11A and 11B, two embodiments of a hollow sliding shaft are shown. Both embodiments have a shaft sidewall 1101. The sidewall 1101 may be configured to have cross-sections of various shapes. For example, sidewall 1101 may have a generally square cross-section, such that the hollow sliding shaft slides through a bushing with a square opening during compression and extension. This feature would allow the bushing to keep the hollow sliding shaft from rotating. Both embodiments shown have a piston plate 1103. The piston may rest atop piston plate 1103, and in some embodiments piston plate 1103 may have a means for connecting the hollow sliding shaft to the piston. For example, piston plate 1103 may have threads that correspond to matching threads at the bottom of the piston. In that manner, piston plate 1103 may be engaged with the piston so that the hollow sliding shaft moves with the piston during compression and extension.

At the top of the hollow sliding shaft may be a pipe close nipple 1105. Pipe close nipple 1105 may allow air to move from the cylinder down into the hollow chamber 1117 within the sliding shaft, and it illustrates just one mechanism for doing so. The mechanism may be any kind of valve or opening configured to provide fluid communication between the cylinder and the hollow chamber 1117 within the sliding shaft. Here, the pipe close nipple 1105 may also serve as a way for the sliding shaft to attach to the piston. The pipe close nipple 1105 may be the portion that attaches to the piston, such as through the use of threads on pipe close nipple 1105 designed to engage with complimentary threads disposed within the piston.

At the bottom of the sliding shaft shown is FIG. 11A is opening 1107. Opening 1107 may instead be sealed off, as shown in FIG. 11B. The bottom of the sliding shaft in FIG. 11B is sealed in order to trap air within the hollow chamber 1117 in the sliding shaft. This allows for additional air storage within the sliding shaft to help create a softer, smoother, and easier bounce for the rider. The exact amount of additional air volume depends on a shaft length, and cross-sectional area of the shaft sidewall 1101. As a non-limiting example, in some designs the addition of a hollow sliding shaft provides for an additional 20 in3 of air storage.

The exact method of sealing off the bottom of the shaft may vary. FIG. 11B shows an embodiment with a welded-in plug 1109. There is a threaded plug 1111 below, with a quarter-inch gap 1115 between the two plugs 1109 and 1111. The threaded plug 1111 may have an opening or means for a bounce bad to be connected to the sliding shaft. For example, threaded plug 1111 has an opening 1113 through which a bounce pad may be screwed or bolted into place. The quarter-inch gap 1115 may allow for additional space so that a bolt can be threaded all the way through the threaded plug 1111 in order to be locked tightly in place.

Figure 12A:
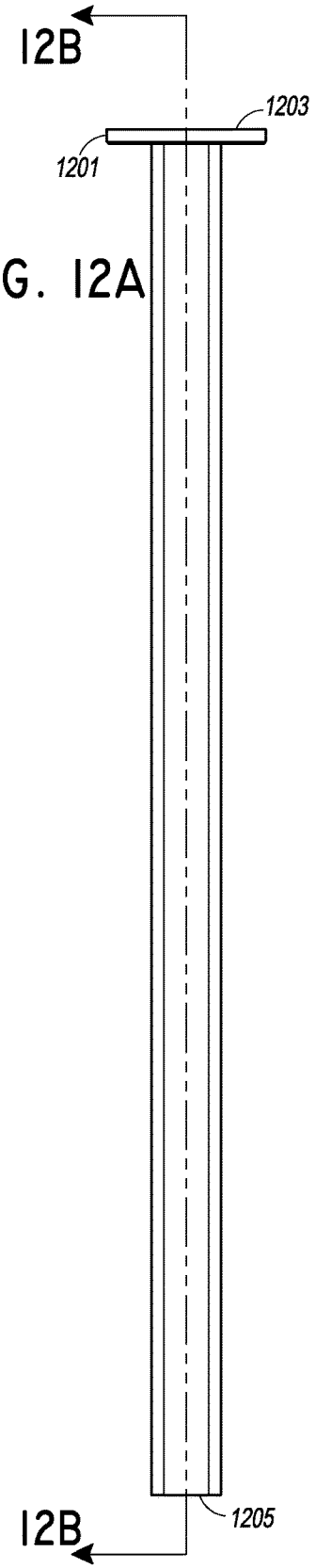
FIG. 12A shows a side elevational cross-section view of one embodiment of an air shaft.
Figure 12B:
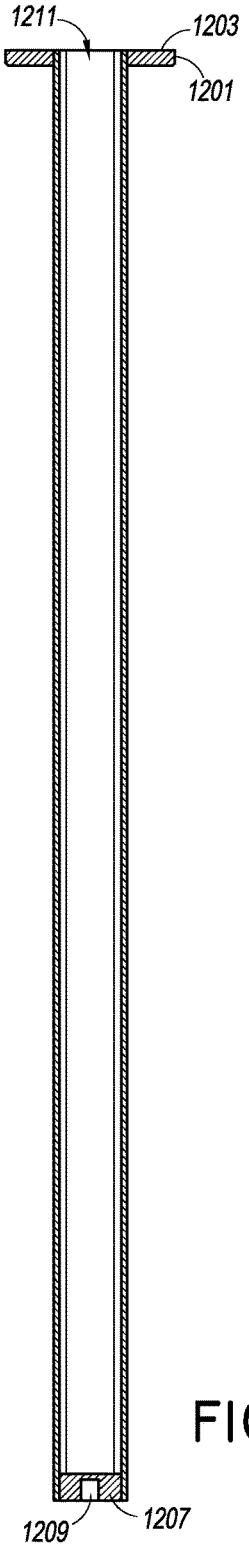
FIG. 12B shows a side elevational cross-section view of one embodiment of an air shaft.

With reference to FIGS. 12A and 12B, different embodiments of the sliding shaft are further shown. The figures show a piston plate 1203, which may have a means for connecting to the piston such as threads 1201 which may match complimentary threads disposed within the piston. These embodiments do not have a pipe close nipple or valve mechanism. Instead, top opening 1211 shown in FIG. 12B may be a mechanism through which air can move from the cylinder into the hollow space within the sliding shaft.

FIG. 12A has an opening 1205 at the bottom of the shaft. However, FIG. 12B is an embodiment where plug 207 is welded into the bottom of the shaft. Plug 207 has bolt socket 1209 in which a bounce pad may be screwed or bolted into place. This embodiment demonstrates how the bottom of the sliding shaft may be welded closed using a single plug, rather than multiple plugs that serve the purposes of welding closed the bottom of the shaft and providing a connection means for a bounce pad.

Hollow Piston

In some embodiments, as shown in FIGS. 5A-D the piston 115 may be elongated such that it is several inches long. The center 305 of the piston 115 may be hollowed out or form a concave structure, such that the volume of space 130 above the piston 115 is increased by the amount of space 310 within the hollowed out or concave portion of the piston 115. In these embodiments, the volume of space above the piston 130 is increased, when the sliding shaft is at maximum extension and at maximum compression. The volume of space 130 may include both the space above the piston 115, between the piston 115 and the cap 160, as well as the volume of space 310 within the piston 115 that fluidly communicates with the space above the piston 115. This configuration may allow the compression ratio of the pogo stick 100 to decrease, similar to the decrease in compression when using a hollow chamber 205 in the sliding shaft 110. The piston 115 may be elongated from the base 315 to the rim 320, and may increase the length of the moment arm of the sliding shaft 115 above the bushing 145. Thus, the spacer 160 may not be necessary. The piston 115 may comprise a groove 325 into which a gasket or seal 135 may be placed. In some embodiments, this groove 325 may be located generally near the top rim 320 of the piston 115. In some embodiments, the groove 325 may be located elsewhere, such as near the base 315 of the piston 115. In some embodiments, the groove 325 may be located between the rim 320 and the base 315 of the piston 115.

For instance, as a non-limiting example, similar to the described above, a pogo stick 100 without a hollow piston 115 may have a maximum stroke length of 18 inches, and 2 inches of length above the top rim of the piston 115 at maximum compression. The inside diameter of the housing 105 may be 3 inches (and the radius of 1.5 inches). At maximum extension the volume of space 130 would be $(18+2)(3.14)(1.5^2)$ or 141.3 $in^2$. At maximum compression the volume of space 130 would be $(2)(3.14)(1.5^2)$ or 14.1 $in^2$. Therefore, the compression ratio would be 10:1. However, if the piston were 4 inches long and was hollowed out to have an inside diameter of 2.5 inches (and a radius of 1.25 inches), then the interior 305 of the piston 115 would add 19.63 $in.^3$ of additional space 310, which may be added to the volume of space 130 at maximum extension and maximum compression. Therefore, the compression ratio would be (141.3+19.63):(14.1+19.63) or 4.77. Other compression ratios may be possible depending on the stroke length, volume of space 130 above the piston 115 at maximum compression, diameter of the cylinder, and volume 310 of the hollow piston 115.

Figure 9B:
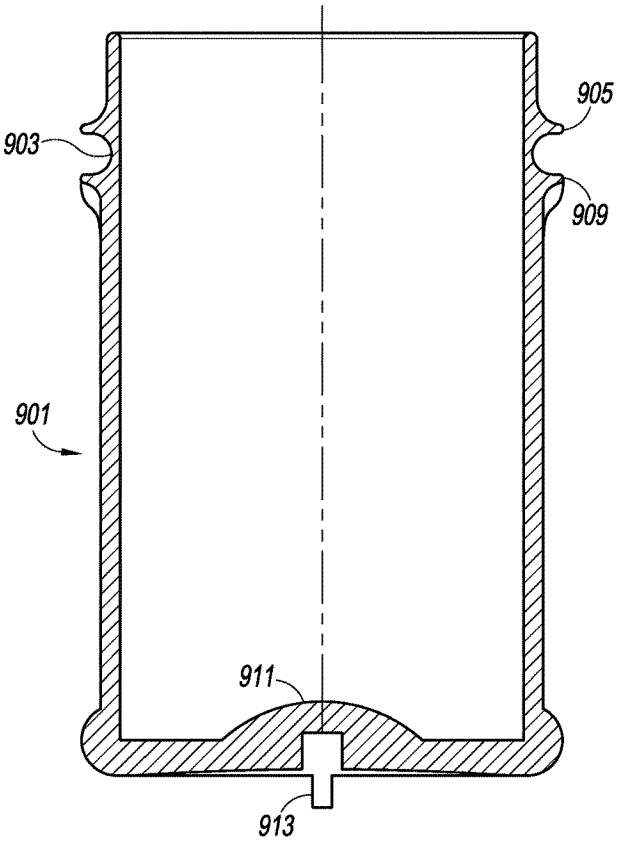
FIG. 9B shows a side elevational cutaway view of one embodiment of a hollow piston.
Figure 9A:
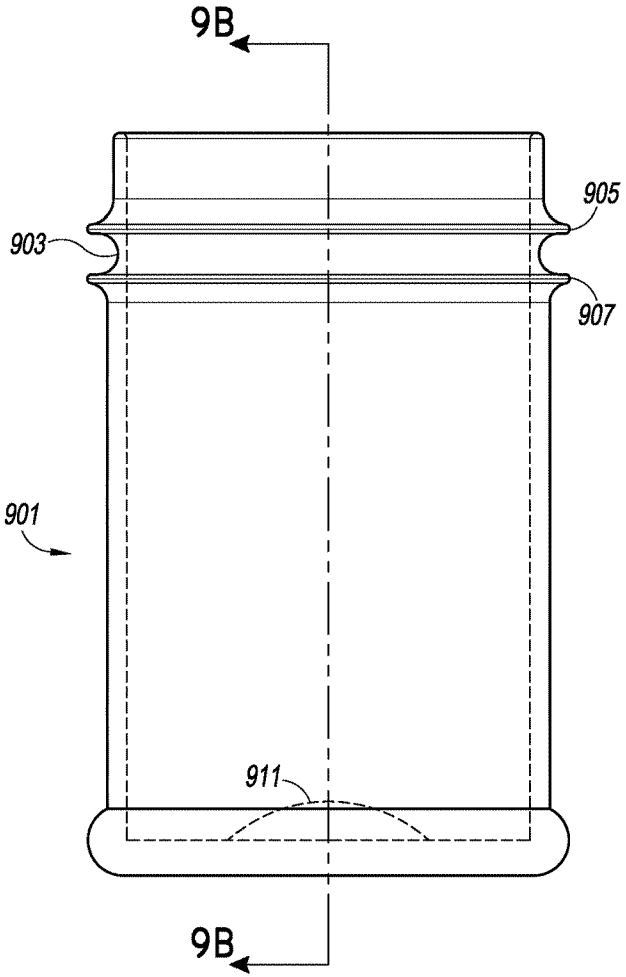
FIG. 9A shows a side elevational see-through view of one embodiment of a hollow piston

With reference to FIGS. 9A and 9B, different embodiments of the hollow piston 901 are shown. Both embodiments have an annular groove 903 in which an o-ring, seal, or gasket can be disposed. This prevents air from flowing around the sides of the hollow piston 901 and going below the piston. Both embodiments may have an overmolded portion 911. The functional aspect of this overmolded portion 911 may be to conceal a means for connecting the piston to the shaft. For example, in FIG. 9B, overmolded portion 911 has a bolt 913 that is overmolded into the bottom of the piston. This bolt 913 may be a way of connecting to a shaft. For example, the shaft may have a piston plate with a socket or recess that bolt 913 may slide into.

The embodiment in FIG. 9A has an annular groove 903 that is comprised of an upper lip 905 and a bottom lip 907. Upper lip 905 and bottom lip 907 serve to hold the seal in place within the annular groove 903.

The embodiment in FIG. 9B has an annular groove 903 that is comprised of upper lip 905 and a bottom lip 909. Bottom lip 909 is thicker than the bottom lip 907 in FIG. 9A. This thicker bottom lip 909 may reinforce the bottom lip 909 against the forces that are exerted upon it by the seal or o-ring during the compression or extension of the shaft.

Hollow Sliding Shaft and Hollow Piston

Figure 6:
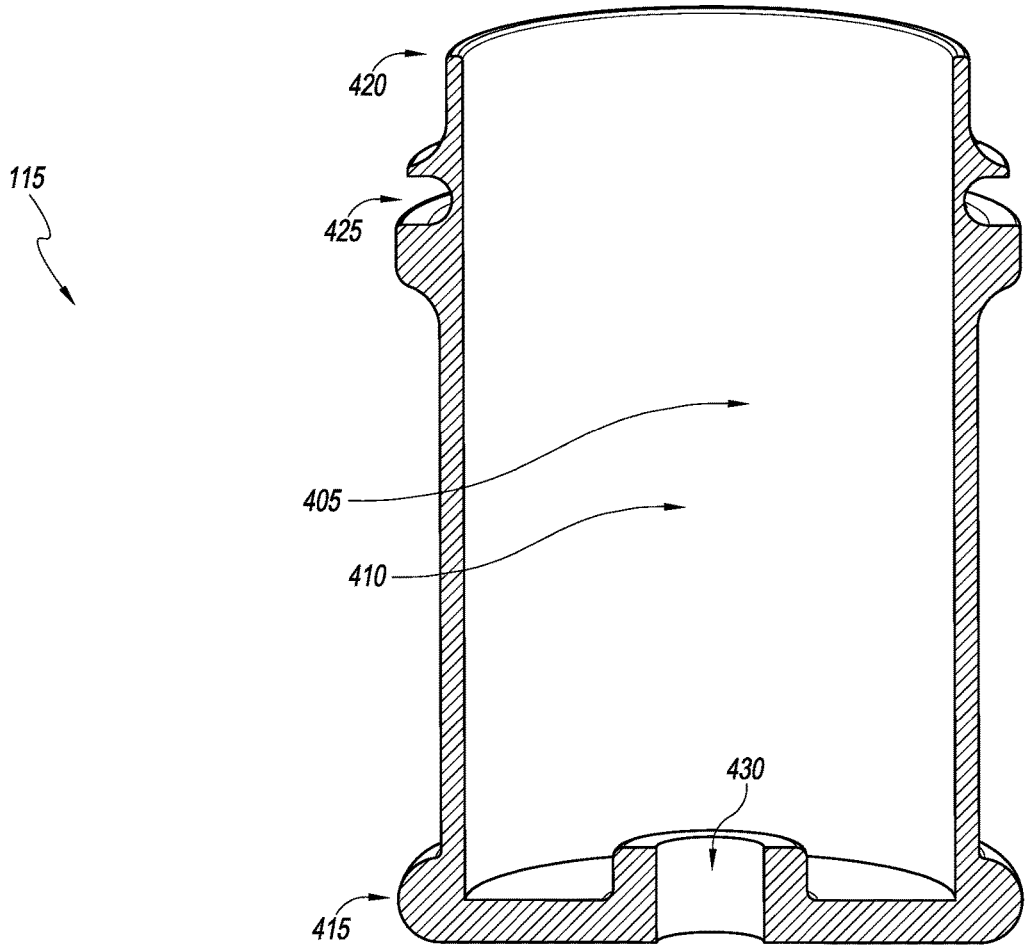
FIG. 6 shows a side elevational cutaway view of a second embodiment of a hollow piston.

In some embodiments, the hollow piston 115 may be combined with a hollow chamber 205 in the sliding shaft 110, to increase the benefits. In these embodiments, the compression ratio may be decreased and/or the stroke length of the sliding shaft 110 may be increased. As shown in FIG. 6, a piston 115 may comprise a center 405 that may be hollowed out or form a concave structure, similar to embodiments described above. The piston 115 may comprise a volume of space 410 within the piston 115, a base 415, a top rim 420, and a groove 425 that may be configured to accept a gasket or seal 135. The piston 115 may additionally comprise an aperture 430 that goes through the bottom surface of the piston 115. When the piston 115 is connected to the sliding shaft 110, the aperture 430 may align with an opening in the sliding shaft, such that air in the hollow portion 410 of the piston 115 may fluidly communicate with the hollow portion 205 of the sliding shaft 110. In some embodiments, the aperture 430 may comprise threads, such that the piston 115 can be threaded on to a portion of the sliding shaft 110.

Piston with Structural Supports

With reference to FIGS. 7A-8E, in some embodiments, a piston 115 may be elongated, with the gasket or seal 135 disposed near or at the base 505 of the piston 115. Portions of the piston 115 may be removed in order to create more space for gases to occupy. However, portions of the elongated piston 115 may remain in order to preserve the preferred moment arm of the sliding shaft 110 near the bushing 145 when the sliding shaft 110 is at maximum extension. As shown in FIG. 7A, the piston 115 may generally be disposed at the end of the sliding shaft 110. The piston 115 may comprise one or more structural supports 510, which may contact the cylinder wall above the end of the sliding shaft 110. The structural supports 510 may be formed integral to the remainder of the piston 115, or may be added during or after manufacturing. The structural supports 510 may comprise various configurations. As shown in FIG. 7B, the structural supports 510 may generally radiate from a central location in the piston 115 and extend to the outer edge 515 of the piston 115.

Figure 8A:
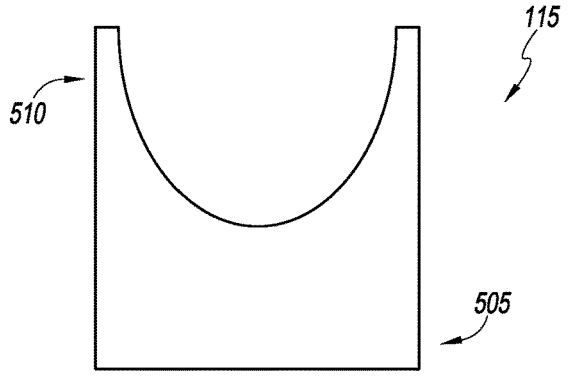
FIG. 8A shows a side elevational cross-section view of a third embodiment of a hollow piston.
Figure 8B:
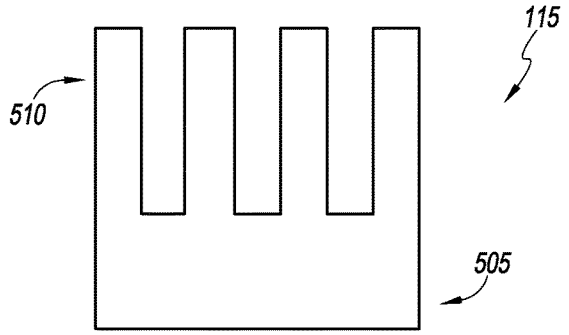
FIG. 8B shows a side elevational cross-section view of a fourth embodiment of a hollow piston.
Figure 8C:
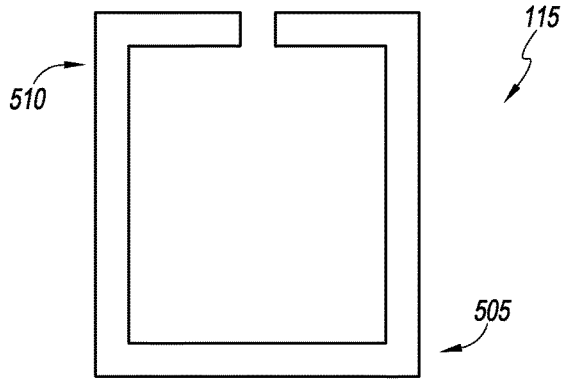
FIG. 8C shows a side elevational cross-section view of a fifth embodiment of a hollow piston.
Figure 8D:
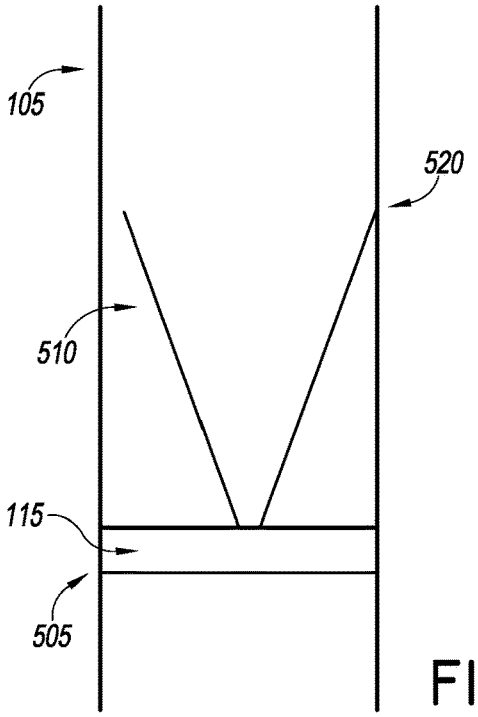
FIG. 8D shows a side elevational cross-section view of a piston comprising a support structure.
Figure 8E:
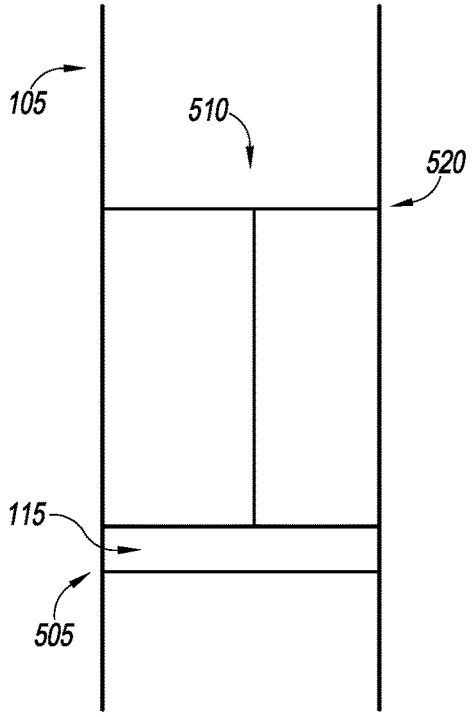
FIG. 8E shows a side elevational cross-section view of a piston comprising a support structure.

As shown in FIGS. 8A-E, the structural supports 510 may comprise various configurations. For instance, in FIGS. 8A-C, the structural supports may comprise the wall sections of the piston 115 with at least portions of the center of the piston removed. In some embodiments, as shown in FIGS. 8D and 8E, structural supports 510 may extend generally vertically from a central location on the piston 115, with an upper end 520 of the supports 510 generally contacting the cylinder wall of the housing 105. In these embodiments, the gasket or seal 135 may be located at or near the base 505 of the piston 115.

These embodiments may result in a decreased compression ratio. Alternatively one may maintain the same decreased compression ratio, while increasing stroke length of the sliding shaft 110. In some embodiments, an increased stroke length may be advantageous to the user because it may allow a different jumping experience. For instance, as a non-limiting example, an increased stroke length may increase the distance over which the force from the ground and from the compressed gases act on the pogo stick 100 tending to direct in an upward direction. Since the same amount of potential energy is being released over a longer distance, the average forces acting on the user may decrease. This may make the pogo stick 100 easier to ride, safer, more enjoyable, and/or may have other benefits. In addition, one may decrease the compression ratio and thus reduce the hammering effect, which may have similar benefits.

In various embodiments described herein, the piston 115 may be described as having a hollow portion or having portions of the piston removed. However, a person of skill in the art would recognize that the piston 115, with the same or similar characteristics, may be produced by simply forming the piston 115 in the desired configuration, eliminating or reducing the need to remove any material. The description of a piston 115 with having material removed is intended to convey the structure of the piston 115, and not to suggest a method of manufacturing, and the scope of the invention is not limited as such.

Figure 10B:
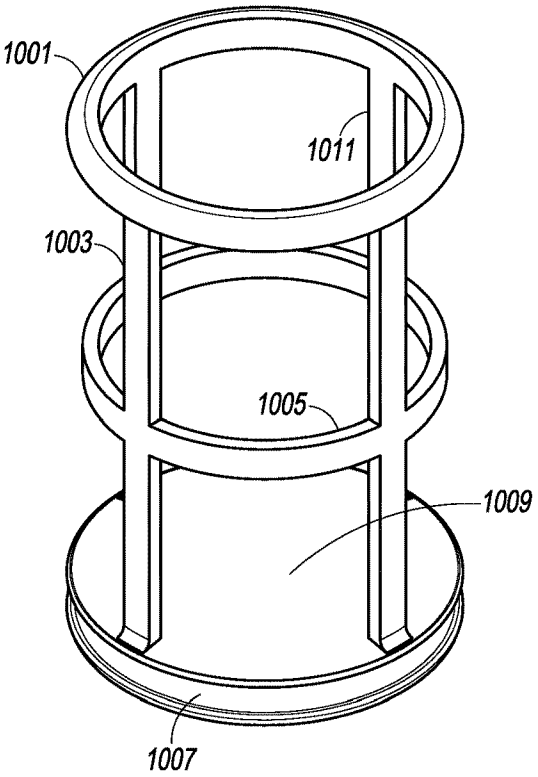
FIG. 10B shows a side elevational isometric view of one embodiment of a piston comprising a support structure.
Figure 10A:
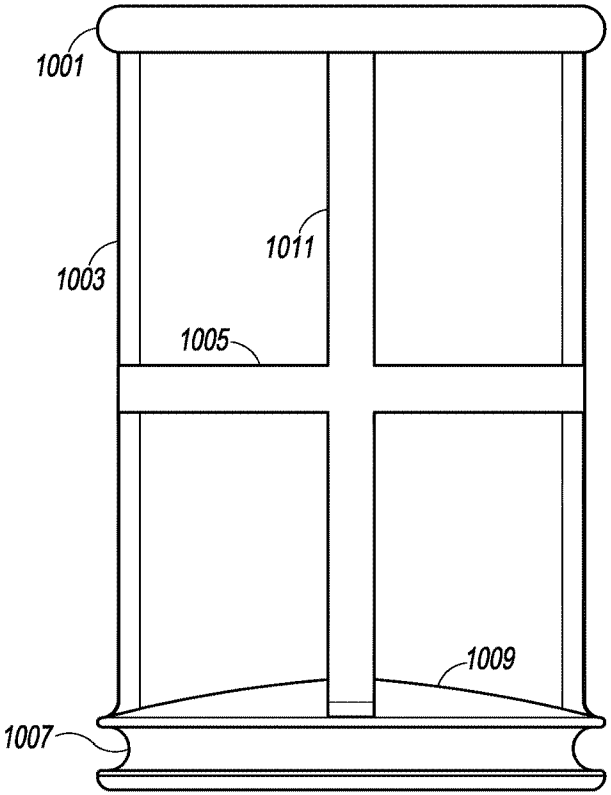
FIG. 10A shows a side elevational view of one embodiment of a piston comprising a support structure.

With reference to FIGS. 10A and 10B, alternate embodiments are shown for the piston 1003 comprising structural supports. Like in FIGS. 7A-8E, the embodiments in FIGS. 10A and 10B also have a generally elongated piston shape. Portions of the piston 1003 may be removed in order to create more space for gases to occupy. Similar to the hollow piston embodiment, this allows for more air storage within the cylinder and tends to reduce the compression ratio. As a non-limiting example, the configuration depicted in FIG. 10A or 10B may add about 8 in3 of additional air storage space within the cylinder, in comparison to a similarly shaped hollow piston embodiment.

The overall structural frame of piston 1003 consists of the top portion of the piston 1001 which comprises an annular shape. The middle portion of the piston 1005 may also have an annular shape and be coaxial to the top portion of the piston 1001. However, top portion of the piston 1001 may be wider than the middle portion of the piston 1005, in order to be firmly seated within the diameter of the cylinder and to keep the piston 1003 from wobbling within the cylinder. In fact, this overall structural frame of the piston 1003 may be necessary to keep the shaft (not pictured) from being able to wobble side to side. Allowing the shaft to wobble from side to side may cause a number of issues, such creating gaps between the seal and the cylinder wall that may allow air to escape from the cylinder.

The top portion of the piston 1001 and the middle portion of the 1005 in the overall structural frame of piston 1003 may be fixed together via one or more vertical structural supports 1011. FIGS. 10A and 10B illustrate four vertical structural supports 1011 used to preserve the generally elongated, cylindrical shape of piston 1003. However, this is just a non-limiting example. There may be any number of vertical structural supports 1011 used in the overall structural frame of piston 1003. As examples, there could be two, three, five, six, and so forth, vertical structural supports 1011. In a similar fashion, there may be any number of annular-shaped supports in the overall structural frame of piston 1003, not just the two annular-shaped supports embodied in the top portion of the piston 1001 and the middle portion of the piston 1005. There could be zero, one, three, and so forth, annular-shaped supports. The total amount of vertical structural supports 1011 and annular-shaped support members may be chosen in order to minimize the amount of space taken up by the overall structural frame of piston 1003, while still providing the desired structural support to the piston 1003 to prevent the shaft from being able to wobble side to side.

FIGS. 10A and 10B further illustrate how an o-ring, gasket, or seal may be disposed within the groove of base 1007 of the piston, for the purpose of preventing gases from moving below the piston. In this configuration, this seal has been moved from the top of the piston to the bottom or base of the piston in order to prevent gases from moving below the piston. There may also be an overmolded portion 1009 of the base. This overmolded portion 1009 may allow for a way for the piston to be attached to the air shaft, such as by allowing a bolt to be overmolded into this overmolded portion 1009 at the bottom of the piston. Overmolded portion 1009 may also allow for air to move from the cylinder to a sliding shaft connected to the piston. For example, overmolded portion 1009 may have an outlet, valve, or opening that allows the air in the cylinder to be in fluid communication attached to a sliding shaft that may be attached to the bottom of piston 1003.

Terminology; Additional Embodiments

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones"

refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment. Conjunctions, such as "and," "or" are used interchangeably and are intended to encompass any one element, combination, or entirety of elements to which the conjunction refers.

What is claimed:

1. A pogo stick comprising:

a housing having a first end and a second end;

a piston disposed within the housing, such that there is an upper confined space between the piston and the first end of the housing; and a sliding shaft at least partially disposed within the housing, said sliding shaft connected to the piston and extending from the second end of the housing;

wherein the piston comprises:

an upper rim;

a lower surface;

a cylindrical piston body extending between the upper rim and the lower surface; and a hollowed out volume of space between the upper rim and the lower surface and within the piston body to form a concave structure, the lower surface enclosing a lower end of the hollowed out volume of space;

wherein the upper rim of the piston defines an opening into the hollowed out volume of space facing the first end of the housing such that the hollowed out volume of space within the piston body is in fluid communication with the upper confined space;

wherein a total internal air volume of the housing includes the hollowed out volume of space at both a maximum extension of the piston and at a maximum compression of the piston to reduce a compression ratio of the total internal volume of the housing.

2. The device of claim 1, wherein the piston is threadably connected to the sliding shaft at the lower base.

3. The device of claim 1, wherein the piston comprises an annular groove on an outside surface of the piston.

4. The device of claim 3, wherein a gasket or seal is disposed within the annular groove on the outside surface of the piston.

5. The device of claim 3, wherein a gasket or seal is disposed within the outer surface of the piston at a top portion of the piston.

6. The device of claim 1, wherein the piston comprises any of: plastic, PVC, nylon, or PTFE.

7. The device of claim 1, wherein the compression ratio is between about 2.0 and 10.0.

8. The device of claim 1, wherein the compression ratio is between about 2.0 and 5.0.

9. The device of claim 1, wherein the compression ratio is between about 2.5 and 4.5.

10. The device of claim 1, wherein the compression ratio is about 3.5.

11. The device of claim 1, wherein the housing comprises: a bumper, a bounce pad, at least one handle, and at least one foot rest.

12. The pogo stick of claim 1 wherein the piston lower surface comprises a first opening and the sliding shaft comprises a hollowed portion and a second opening aligned with the first opening, and wherein the piston piston's hollowed out volume of space is in fluid communication with the hollowed portion of the sliding shaft.

13. A pogo stick comprising:

a housing having a first end and a second end;

a piston disposed within the housing, such that there is an upper confined space between the piston and the first end of the housing; and a sliding shaft at least partially disposed within the housing, said sliding shaft connected to the piston and extending from the second end of the housing, the sliding shaft comprising a lower confined space therein;

wherein the piston comprises:

an upper rim;

a lower surface;

a piston body extending between the upper rim and the lower surface; and a hollowed out volume of space between the upper rim and the lower surface and within the piston body to form a concave structure, the lower surface partially enclosing a lower end of the hollowed out volume of space;

wherein the upper rim of the piston defines an upper opening into the hollowed out volume of space facing the first end of the housing such that the hollowed out volume of space within the piston body is in fluid communication with the upper confined space through the upper opening;

wherein the lower surface of the piston comprises a lower aperture that extends through the lower surface such that and the hollowed out volume of space in the piston is in fluid, two-way communication with the lower confined space within the sliding shaft through the lower aperture;

wherein a total internal volume of the pogo stick includes a volume of the lower confined space at both a maximum extension of the piston and at a maximum compression of the piston to reduce a compression ratio of the total internal volume of the pogo stick.

* * * * *